US005956686A

United States Patent [19]

Takashima et al.

[11] Patent Number: 5,956,686

[45] Date of Patent: Sep. 21, 1999

[54] AUDIO SIGNAL CODING/DECODING METHOD

[75] Inventors: Makoto Takashima, Funabashi; Yoshiaki Asakawa, Kawasaki; Hidetoshi Sekine, Hachioji, all of Japan

[73] Assignee: Hitachi, Ltd., Tokyo, Japan

[21] Appl. No.: 08/497,474

[22] Filed: Jun. 30, 1995

[30] Foreign Application Priority Data

Jul. 28, 1994 [JP] Japan ..... 6-176496

[51] Int. Cl.[6] ..... G10L 9/04; G10L 9/14

[52] U.S. Cl. ..... 704/500; 704/209; 704/219; 704/220

[58] Field of Search ..... 395/2.28, 2.29, 395/2.3–2.32, 2.35, 2.38, 2.39, 2.09, 2.18, 2.91; 704/500, 219–223, 226, 229, 230, 200, 209

[56] References Cited

U.S. PATENT DOCUMENTS

| | | | |
|---|---|---|---|
| 4,622,680 | 11/1986 | Zinser | 704/205 |
| 4,975,956 | 12/1990 | Liu et al. | 395/2.28 |
| 5,150,387 | 9/1992 | Yoshikawa et al. | 395/2.38 |
| 5,214,741 | 5/1993 | Akamine et al. | 395/2.35 |
| 5,235,669 | 8/1993 | Ordentlich et al. | 395/2.09 |
| 5,241,535 | 8/1993 | Yoshikawa | 370/60 |
| 5,301,205 | 4/1994 | Tsutsui et al. | 375/1 |
| 5,526,464 | 6/1996 | Mermelstein | 395/2.28 |
| 5,546,498 | 8/1996 | Sereno | 395/2.38 |
| 5,633,980 | 5/1997 | Ozawa | 395/2.31 |

*Primary Examiner*—David D. Knepper

*Attorney, Agent, or Firm*—Antonelli, Terry, Stout & Kraus, LLP

[57] ABSTRACT

An adaptive transform coding/and decoding arrangement is provided to effectively exploit different redundancies between the bands of a spectrum envelope to effect coding at a low bit rate for an audio signal. In the adaptive transform coding method, the spectrum envelope is divided into bands so that different coding methods may be applied to the spectrum envelopes of the individual bands. By applying the present invention to the adaptive transform coding of an audio signal, the spectrum envelope can be adjusted to the coding/and transmission method which is suitable for the time fluctuation in each frequency band, so that the different redundancies for the individual bands can be effectively exploited to realize a highly efficient audio signal coding/and decoding method which has its bits reduced as required for coding the spectrum envelope.

14 Claims, 9 Drawing Sheets

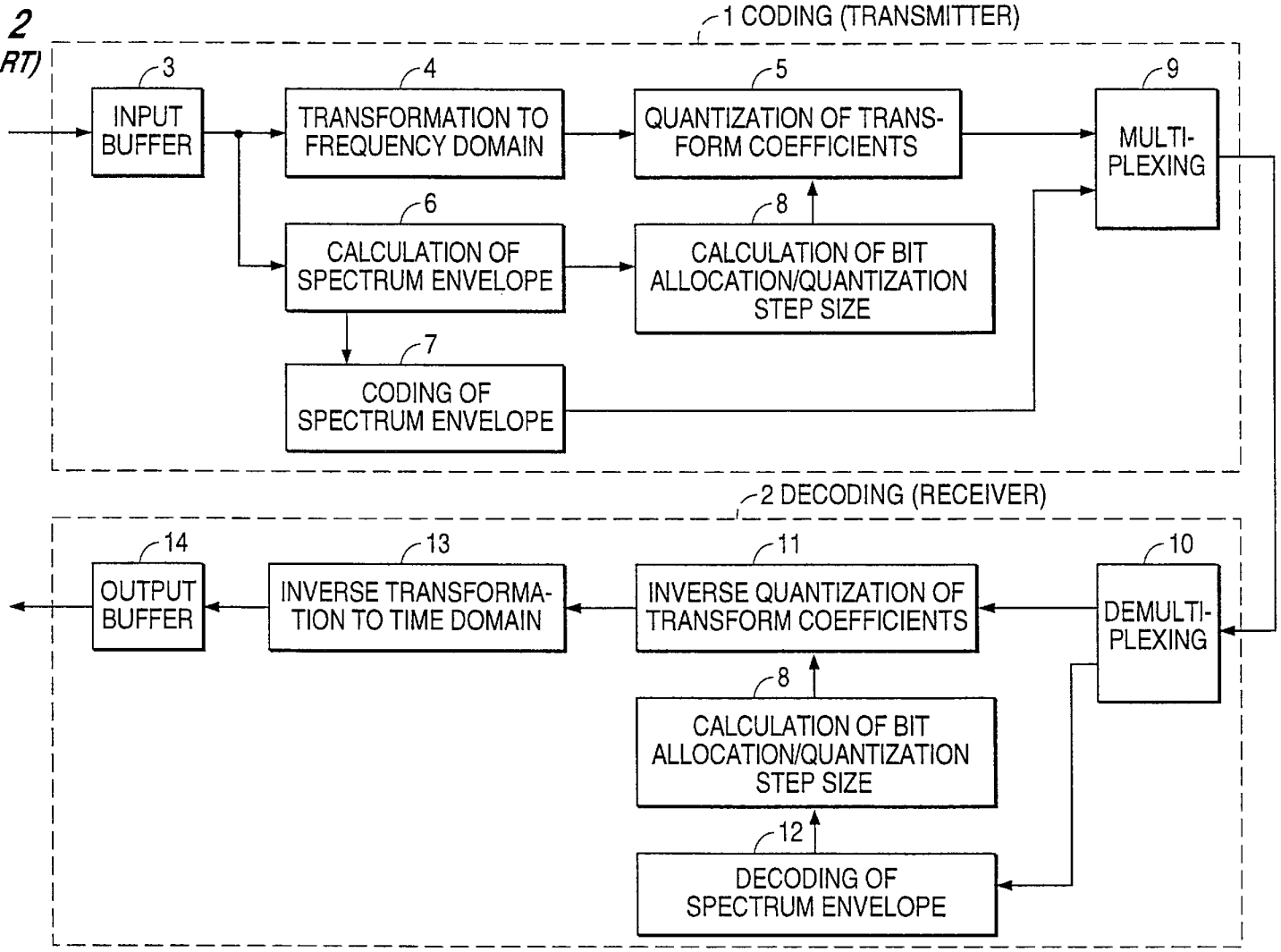
FIG. 2
(PRIORART)

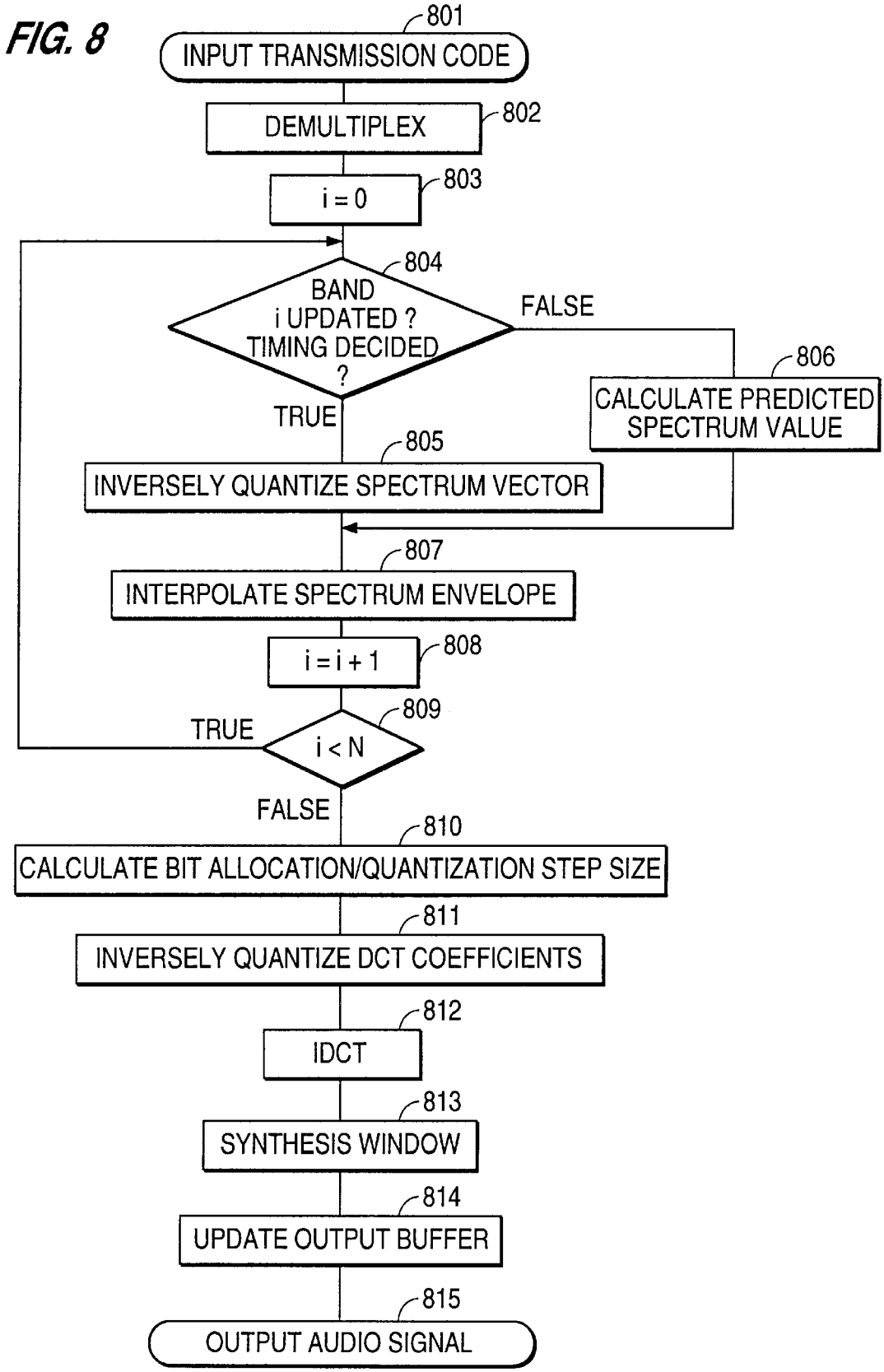
FIG. 8
801
INPUT TRANSMISSION CODE
DEMULTIPLEX
802
i = 0
803
804
BAND
i UPDATED ?
TIMING DECIDED
?
FALSE
806
CALCULATE PREDICTED SPECTRUM VALUE
TRUE
805
INVERSELY QUANTIZE SPECTRUM VECTOR
807
INTERPOLATE SPECTRUM ENVELOPE
i = i + 1
808
809
TRUE
i < N
FALSE
810
CALCULATE BIT ALLOCATION/QUANTIZATION STEP SIZE
811
INVERSELY QUANTIZE DCT COEFFICIENTS
812
IDCT
813
SYNTHESIS WINDOW
814
UPDATE OUTPUT BUFFER
815
OUTPUT AUDIO SIGNAL

AUDIO SIGNAL CODING/DECODING METHOD

BACKGROUND OF THE INVENTION

The present invention relates to communication and recording operations of audio signals, and, more particularly, to an audio signal coding/and decoding method.

In recent years, vigorous development has occurred in the area of high-quantity speech coding for wide band speech used, for example, in videoconferencing or the like, and in the area of high-quality audio coding, used, for example, in multimedia. In such coding methods, an adaptive transform coding method using the spectrum envelope information as side information has frequently been used. This coding/and decoding method using such an adaptive transform coding method is exemplified in the prior art by the method disclosed as "Adaptive Transform Coding Method and System" in Japanese Patent Laid-Open No. 184098/1991, or the method, as disclosed as "Transform Coding of Audio Signals Using Perceptual Noise Criteria" by James D. Johnston: IEEE Journal on Selected Areas in Communications, Vol. 6, No.2".

For preparing the description of the present invention, an adaptive transform coding method which is used in the prior art will first be described. FIG. 2 is a diagram showing a summary of the processing flow of such an adaptive transform coding/and decoding method between a coding transmitter 1 and a decoding receiver 2.

In FIG. 2, reference numeral 3 designates processing of an input buffer for storing a predetermined number of samples of a digitized input, to construct a coding block. Numeral 4 designates processing for transforming the input audio signal to a frequency domain by a fast Fourier transform or the like providing an output of a plurality of discrete frequency bands. Numeral 13 designates processing for inverse transforming to a time domain, as corresponds to the transformation 4. Numeral 5 designates processing for quantizing the transform coefficient by using a Max. quantizer, and numeral 11 designates processing for an inverse quantization, as corresponds to the quantization 5. Numeral 6 designates processing for calculating a spectrum envelope. This can be done, for example, by using a method of approximating the spectrum envelope by averaging the powers of the transform coefficients of the frequency domain for several discrete frequency bands, a method of deducing the spectrum envelope by linearly predictively analyzing the input, and so on. Numeral 7 designates processing for coding the spectrum envelope, and numeral 12 designates processing for decoding the spectrum envelope, as corresponds to the coding 7. Numeral 8 designates processing for adaptively controlling the bit allocation/and quantization step size of the transform coefficient quantization of each discrete frequency band on the basis of the rate-distortion theorem or the like. Numeral 9 designates processing for multiplexing the quantization transform coefficient and the spectrum envelope code to generate a transmission code, and numeral 10 designates processing for demultiplexing the transmission code to decode the quantization transform coefficient and the spectrum envelope code. Numeral 14 designates an output buffer for storing the output signals as the unit of a block to output them sequentially.

The coding/and decoding flow will be described with reference to FIG. 2. In the coding operation, a coding block is constructed from the input audio signal by the buffer 3 and is transformed into a transform coefficient by the frequency domain transformation 4 until it is quantized by the transform coefficient quantization 5. In this transform coefficient quantization 5, the coefficient of each discrete frequency band is quantized with a bit allocation and a quantization step size which are adaptively controlled on the basis of the spectrum envelope obtained by the spectrum envelope calculation 6 from the input signal. These operations are accomplished for auditorily controlling the quantization distortion of each discrete frequency band. On the other hand, the full band of the spectrum envelope is coded by the coding operation 7. Then, the transmission code is generated from the quantization transform coefficient and the spectrum envelope code by the multiplexing operation 9.

In the decoding operation 2, the quantization transform coefficient and the spectrum envelope code are separated at first by the demultiplexing operation 10. Then, the spectrum envelope is decoded by the spectrum envelope decoding operation 12, and the bit allocation/and quantization step size are calculated by the bit allocation/and quantization step size calculation 8 on the basis of the decoded spectrum envelope so that the transform coefficient is decoded in the inverse transform coefficient quantization 11 by applying the bit allocation/and quantization step size. This coefficient is transformed into a time-domain signal by the inverse time domain transformation 13 and is stored in the output buffer 14 so that it is sequentially outputted to decode the audio signal.

In the adaptive transform coding method described above as prior art, the full band of the spectrum envelope is coded by an identical coding method and is updated for each full-band block. On the other hand, the time fluctuation of the spectrum envelope of the audio signal can be different for different bands within the full band, and generally has a tendency that the time fluctuation diminishes in the lower frequency domain. Thus, a band with a small time fluctuation has a large correlation between the adjoining blocks and a large redundancy. However, this redundancy is not effectively exploited to have a low coding efficiency by the adaptive transform coding method of the prior art, in which the spectrum envelope is coded by the identical coding method for the full band and is updated at each full-band block. Especially in case the spectrum envelope is to be estimated by linear predictive analysis, the method of the prior art has been unable to consider the differences of the time fluctuation for each band, because the input signal is analyzed as a whole for the full band so that the linear prediction coefficient is calculated/and coded and transmitted.

In the prior art, as described above, there is no consideration of redundancy which is caused by the difference in the time fluctuation of the spectrum envelope between the bands. Hence, the prior art is insufficient for providing an adaptive transform coding/and decoding method for low bit-rate coding of high quality.

SUMMARY OF THE INVENTION

An object of the present invention is to solve these problems and to provide an audio signal coding/and decoding method capable of effectively using different redundancies for the different bands and effectively exploiting the redundancy component of the spectrum envelope independently of the characteristics of a audio signal.

In order to solve the problems, the present invention uses the spectrum envelope of a frequency component of an audio signal which is band-divided so that coding suitable for the time fluctuation in the spectrum envelope for each band can be carried out.

BRIEF DESCRIPTION OF THE DRAWINGS

FIG. 2 is a construction diagram showing the principle of a known audio signal adaptive transform coding/and decoding method.

FIG. 8 is a flow chart of the decoding method of the third embodiment of the present invention.

DETAILED DESCRIPTION

Figure 1A:
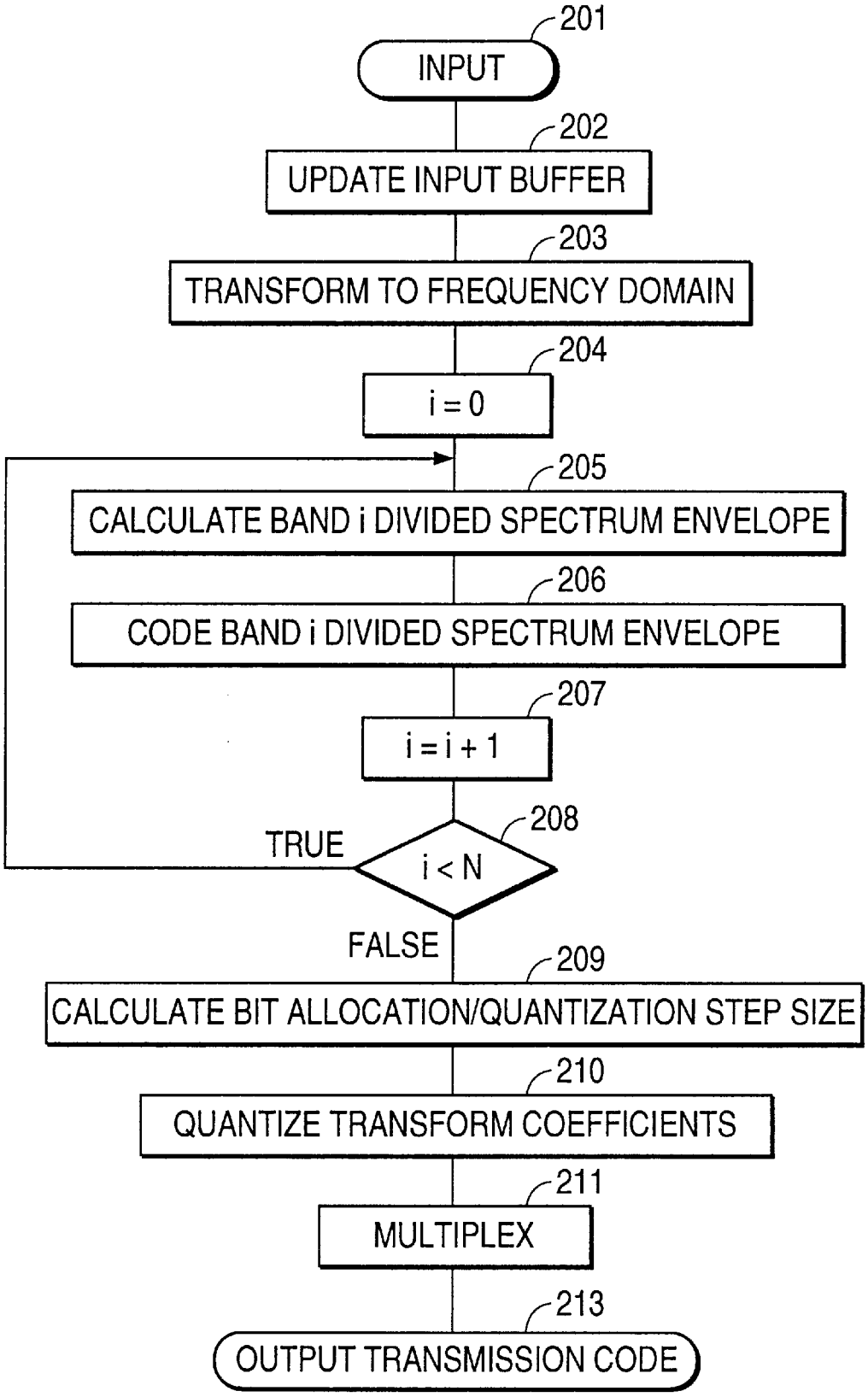
FIGS. 1A and 1B are flow charts showing the operations of an audio signal coding/and decoding method of the present invention.
Figure 1B:
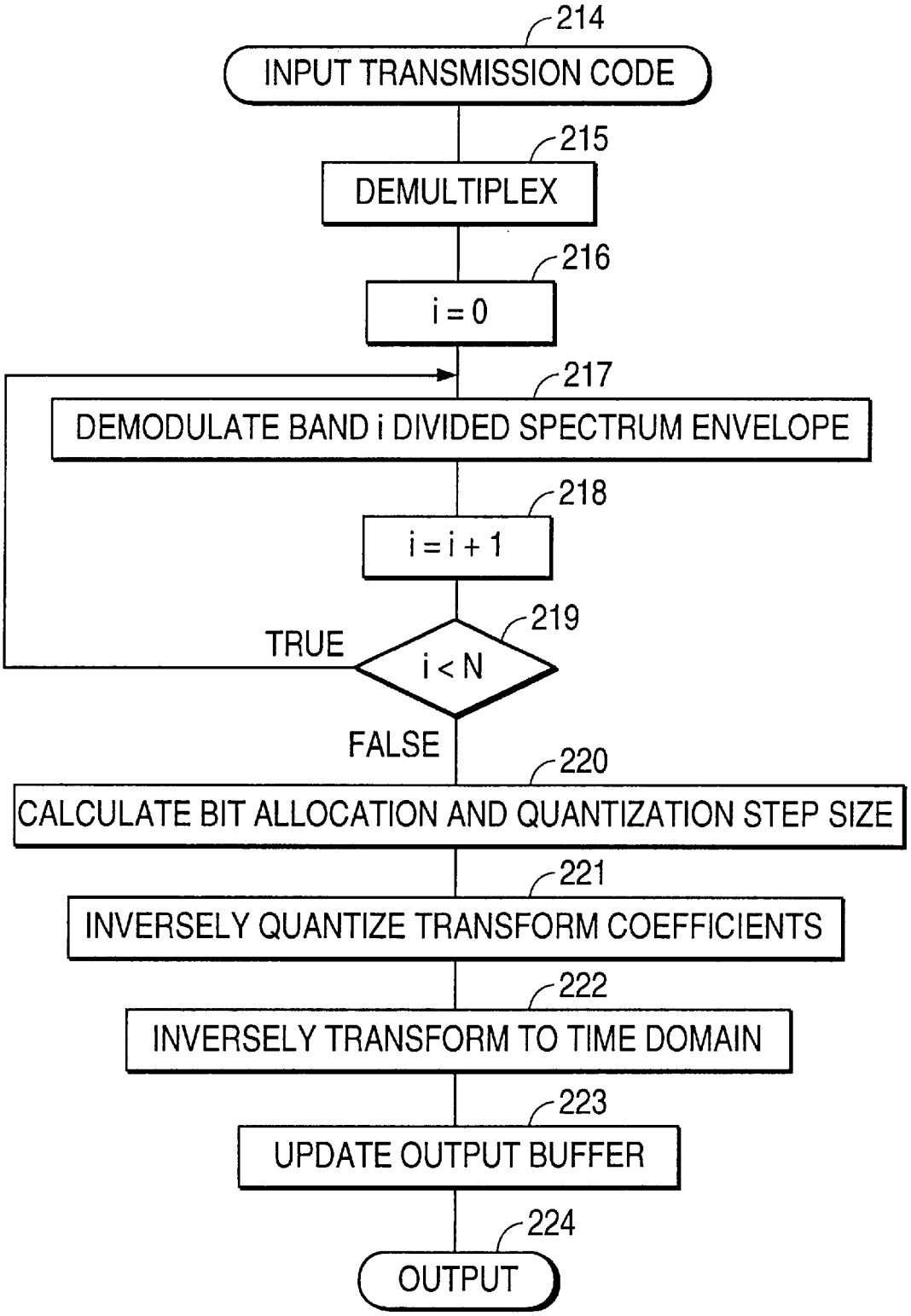

The processing flow of this method is shown in FIGS. 1A and 1B. In FIGS. 1A and 1B, letter i designates an index of the bands which are assigned sequentially beginning from a lower frequency domain up to a higher frequency domain, and letter N designates the number of divided bands of the spectrum envelope. In other words, if the spectrum envelope is divided into two (2) bands (i.e., N=2), the band i=1 will be the band at the lowest frequency domain and the band i=2 will be the band at the highest frequency domain.

In FIGS. 1A and 1B the following elements and steps are shown: Step 203 executes a transformation of the fast Fourier transform to a frequency domain, although not especially limited thereto; Step 222 executes a transformation to a time domain, as corresponds to Step 203; Steps 209 and 220 execute calculations of the bit allocation/and quantization step size on the basis of the rate-distortion theorem or the like although not especially limited thereto; Step 210 executes a quantization of the Max quantizer or the like, although not especially limited thereto; and Step 221 executes an inverse quantization, as corresponds to Step 210. The means for solving the problems of the prior art by use of the present invention will be described with reference to FIG. 3.

In the coding operation, first of all, M samples of the sampled audio signal inputted at Step 201 are stored at the input buffer updating Step 202 to construct a coded block. The value M is not especially limitative. This coding block is transformed at Step 203 into a frequency domain to calculate the transform coefficients.

Next, after a band index initialization Step 204 (i=0), the spectrum envelope of a first band i is calculated by Step 205 for calculating the band i divided spectrum envelope, and its coding is executed at Step 206 for the coding band i divided spectrum envelope. Here, at the band i divided spectrum envelope calculation Step 205, the spectrum envelope is divided into a plurality of bands, in case the averaged power value of the transform coefficient of the adjoining bands is the spectrum envelope, and the input signal is band-divided to perform the linear predictive analysis so that the spectrum envelope is calculated for each divided band, in case the spectrum envelope is predicted by the linear predictive analysis. On the other hand, the band i divided spectrum envelope coding Step 206 is a coding step set to the method which is best suited for the time fluctuation of the particular band i spectrum envelope. This Step 206 makes it possible to use different methods for the individual bands, such as a backward adaptation, an inter-block predictive coding method or a method of elongating the updating period, for a band having a small time fluctuation. A band index addition Step 207 is performed, followed by a band processing end decision Step 208.

The Steps 205 to 208 thus far described are executed for each of the N bands so that the spectrum envelope of the full band of the frequency component of the audio signal is approximated. On the basis of this, the bit allocation/and quantization step size of each discrete frequency band to be applied to the transform coefficient quantization 210 is determined at the bit allocation/and quantization step size calculation Step 209, and the transform coefficient 210 already determined at Step 203 is quantized at Step 210. At the multiplexing Step 211, moreover, the transform coefficient code, the spectrum envelope code and other codes are multiplexed to output the transmission codes in Step 213.

At the decoding side, the transform coefficient code, the spectrum envelope code and other codes of transmission code input Step 214 are at first demultiplexed at the demultiplexing Step 215. After a band index initialization Step 216, a band i divided spectrum envelope demodulation Step 217 is executed to decode the spectrum envelope of the band i for each band i. This decoding is executed using band index addition Step 218 and band processing end decision Step 219 for the N bands to construct the spectrum envelope for the full band. The bit allocation/and quantization step size of the transform coefficient of each discrete frequency band are then determined at the bit allocation/and quantization step size calculation Step 220 so that the transform coefficient is decoded at the inverse transform coefficient quantization Step 221. This decoded transform coefficient is transformed into the time-domain signal at the inverse transformation Step 222 and is sequentially outputted by updating the output buffer at an output buffer updating Step 223 to decode the audio signal, as indicated by an output 224.

In the present invention, the method using different coding for the individual bands by band-dividing the spectrum envelope, as described above, is applied to the adaptive transform coding method so that the coding can be accomplished while considering the differences of the time fluctuation of the spectrum envelope of the audio signal for the individual bands. Especially, the redundancy of any band having a small time fluctuation can be effectively utilized to realize spectrum envelope coding of a low bit rate while suppressing the coding distortion in the adaptive transform coding method.

Figure 3:
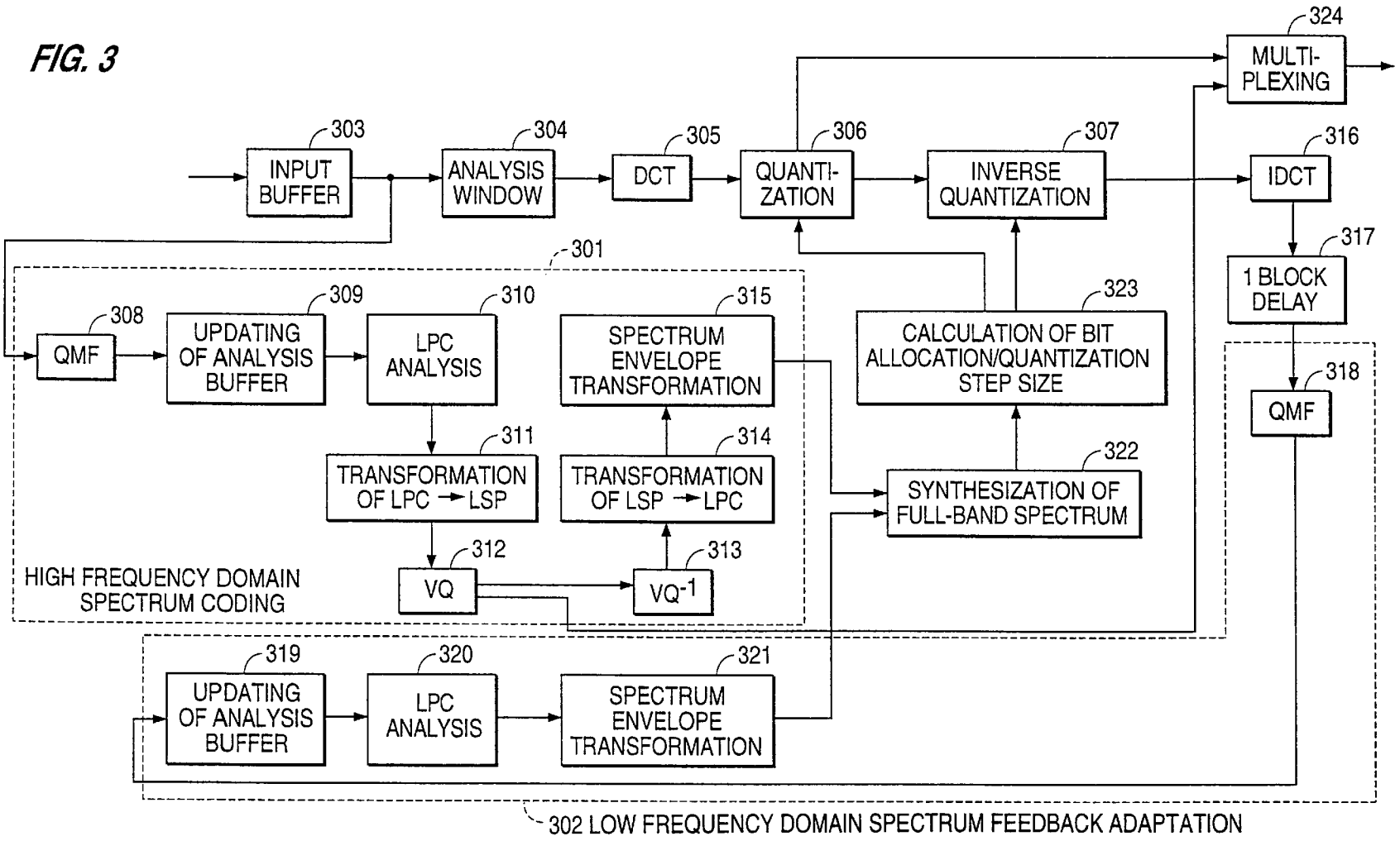
FIG. 3 is a construction diagram of the coding operation of a first embodiment of the present invention.
Figure 4:
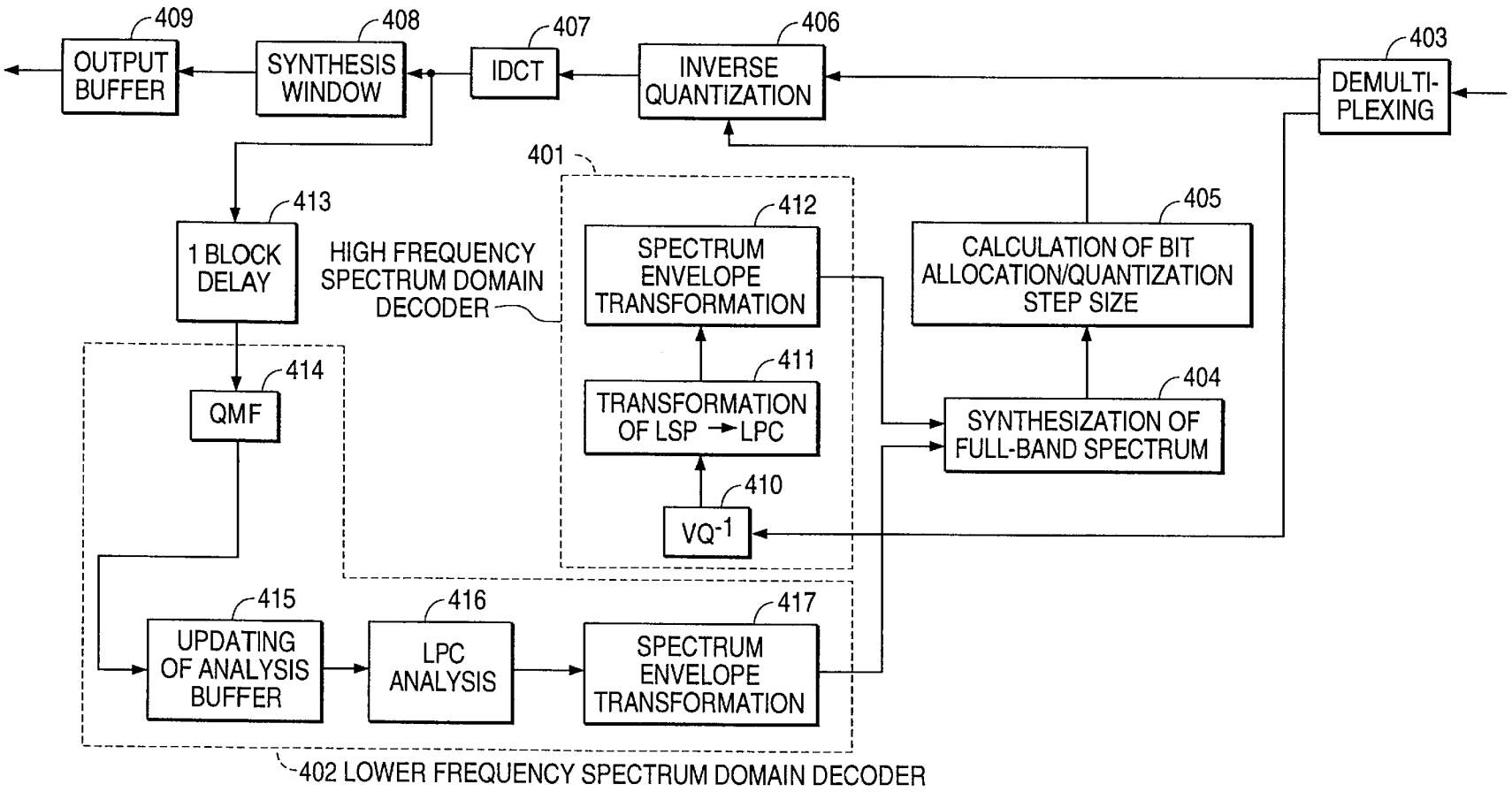
FIG. 4 is a construction diagram of the decoding operation of the first embodiment of the present invention.

A first embodiment of the present invention is shown in FIGS. 3 and 4. Of these, FIG. 3 is a construction diagram of the present embodiment at the coding side, and FIG. 4 is a construction diagram at the decoding side. The present embodiment is directed to an example of N=2 in which an audio band is divided into a higher frequency band and a lower frequency band (of which the higher frequency band will be called the "higher frequency domain" whereas the lower frequency band will be called the "lower frequency domain"), for which different audio coding/and decoding methods are individually used.

The coding operation will be described with reference to FIG. 3. In this coding operation, a sampled input is inputted at first to an input buffer 303. In the present embodiment, the input is an audio signal having its band limited to 50 to 7,000 Hz with a sampling frequency of 16 KHz. The buffer 303 stores 120 samples subsequent to the just preceding 8 samples to construct a coding block. In short, this coding block has an overlapped component of 8 samples. This input is multiplied by an analysis window 304 W(t), as expressed by the following Equation 1:

$$w(t) = \begin{cases} 1 & M \le t \le L - M - 1 \\ \frac{1}{2}\left(1 - \cos\frac{t}{M}\pi\right) & 0 \le t \le M \\ \frac{1}{2}\left(1 - \cos\frac{t - L - 1}{M}\pi\right) & L - M \le t \le L - 1 \end{cases}$$

In Equation 1, M: number of overlap samples in a coding block, t: an index of the position of a sample in the coding block, and L: a sample of the coding block. In the present embodiment, L in Equation 1 is 128, and M is 8. The windowed coding block is subjected at 128 points to a discrete cosine transformation by a DCT 305 so that it is transformed into a DCT coefficient. This coefficient is quantized by a quantization 306 composed of Max quantizers of 1 to 5 bits. In this quantization 306, the bit allocation/and quantization step size of the DCT coefficient of each discrete frequency band is controlled by a bit allocation/and quantization step size calculation 323. In the present embodiment, the bit allocation $R_j$ is calculated by the following Equation 2:

$$R_j = R^* = \frac{1}{2}\log 2\sigma_j^2 \frac{1}{2}\sum_{j=0}^{L} \log_2 \sigma_j^2$$

The quantization step size $S_j$ is calculated by the following Equation 3:

$$S_j = \frac{1}{\sigma_j}$$

Incidentally, in Equations 2 and 3, j: an index of the frequency band of a transform coefficient allocated sequentially from the lower frequency domain, $\sigma_j$: a spectrum envelope at the band j, and R*: an average bit number per sample. In the present embodiment, the value R* is set to 1.93. In the present embodiment, moreover, the spectrum envelope has its higher frequency domain (i.e., 4 KHz to 7 KHz) determined at a coding side 301 and its lower frequency domain (i.e., 50 Hz to 4 KHz) determined at a decoding side 302, and the 7-bit vector quantization is applied to the higher frequency domain whereas the feedback adaptive method is applied to the lower frequency domain.

In the high frequency domain spectrum calculation/and coding 301, the higher frequency domain signal (i.e., 4 KHx to 7 KHz) is calculated at first from the input by a QMF (i.e., Quadrature Mirror Filter) 308 constructed of the well-known 24-tap QMF, and a higher frequency domain spectrum envelope analyzing buffer is updated by a analysis buffer updating 309. This higher frequency domain spectrum envelope analyzing buffer is composed of 100 samples. For this analysis buffer, an eighth degree linear predictive analysis is performed in an LPC analysis 310 to calculate the linear prediction coefficient (LPC). This coefficient is transformed by an LPC→LSP transformation 311 into a linear spectrum pair (LSP) and is subjected to a vector quantization of 7 bits in a VQ 312. On the other hand, the code is inversely quantized in VQ-1 313 and is transformed by an LSP→LPC transformation 314 into a quantized LPC coefficient until it is transformed by a spectrum envelope transformation 315 into a higher frequency domain spectrum envelope.

In the lower frequency domain spectrum calculation 302, on the other hand, a feedback adaptive method is used in which the spectrum envelope of the input is approximated with the value calculated from the preceding coding/and decoding signal. For this, the transform coefficient is determined from the transform coefficient code by an inverse quantization 307 and is subjected to an inverse cosine transformation in an IDCT 316 at 128 points so that the decoded signal is latched for the time period of 1 block in a 1-block delay 317. This decoded signal has its band divided by a 24-tap QMF 318 to determined a lower frequency domain signal, and the lower frequency domain spectrum analysis buffer composed of 100 samples is updated by a analysis buffer updating Step 319. For this analysis buffer, an LPC analysis of the twelfth degree is executed by an LPC analysis 320, and a lower frequency domain spectrum envelope is calculated by a spectrum envelope transformation 321.

The lower and higher frequency domain spectrum envelopes determined at 301 and 302 are synthesized in a full-band spectrum synthesization 322 and are applied for the operations of the aforementioned bit allocation/and quantization step size calculation 323. Moreover, the transmission code is constructed from the transform coefficient code and the higher frequency domain LSP code by a multiplexing Step 324.

Next, the decoding operations will be described. In this decoding operation, the transmission code is divided at first into the transform coefficient code and the higher frequency domain LSP code of 7 bits by a demultiplexing Step 403. The higher frequency domain spectrum envelope is decoded in a unit 401, as shown. The higher frequency domain LSP code is inversely quantized in a VQ-1 step and is transformed into the quantized LPC coefficient by an LSP→LPC transformation 411 until it is decoded into the higher frequency domain spectrum envelope by the spectrum envelope determining Step 315. On the other hand, the lower frequency domain spectrum is calculated in the decoding unit 402, as shown, by the backward adaptive method. This feedback adaptive method at this decoding side is similar to that at the coding side. The decoded signal latched by a 1-block delay 413 has its band divided by a 24-tap QMF 414. With this lower frequency domain signal, the lower frequency domain spectrum analyzing buffer is updated by an analysis buffer updating Step 415, and an LPC analysis of the twelfth degree is executed in an LPC analysis 416 so that the lower frequency domain spectrum envelope is achieved in a spectrum envelope transformation Step 417. As at the coding side, moreover, a full-band spectrum synthesis 404 is executed to achieve the transform coefficient quantizing conditions in a bit allocation/and quantization step size calculation 405 by operations similar to those of the coding side 323. On the basis of the conditions, the transform coefficient is subjected to an inverse quantization 406 and an IDCT operation 407 at 128 points. This coefficient is multiplied by the synthesis window w(t) of Equation 4 shown below, in Step 408, and the overlapped 16 samples are added to determine an output signal. These output signals are stored in an output buffer 409 and are sequentially outputted to produce a decoded output.

$w(t)=1 \quad 0 \leqq t \leqq L-1$

The present embodiment utilizes a high correlation between the blocks of the lower frequency domain spectrum envelope, and the backward adaptive method is used for the lower frequency domain spectrum envelope whereas only the higher frequency domain spectrum envelope is coded/and transmitted. As a result, an excellent sound quality is achieved even if 7 bits/block are required for coding the spectrum envelope. According to the present embodiment, a better sound quality is achieved for an equal transmission bit rate than that of the case in which the LSP is quantized/and transmitted for the full band as a whole.

Moreover, excellent sound quality can be achieved at the transmission bit rate of 32 Kbits/s by incorporating the audio signal coding/and decoding method of the present embodiment into a wide band telephone system.

Figure 5:
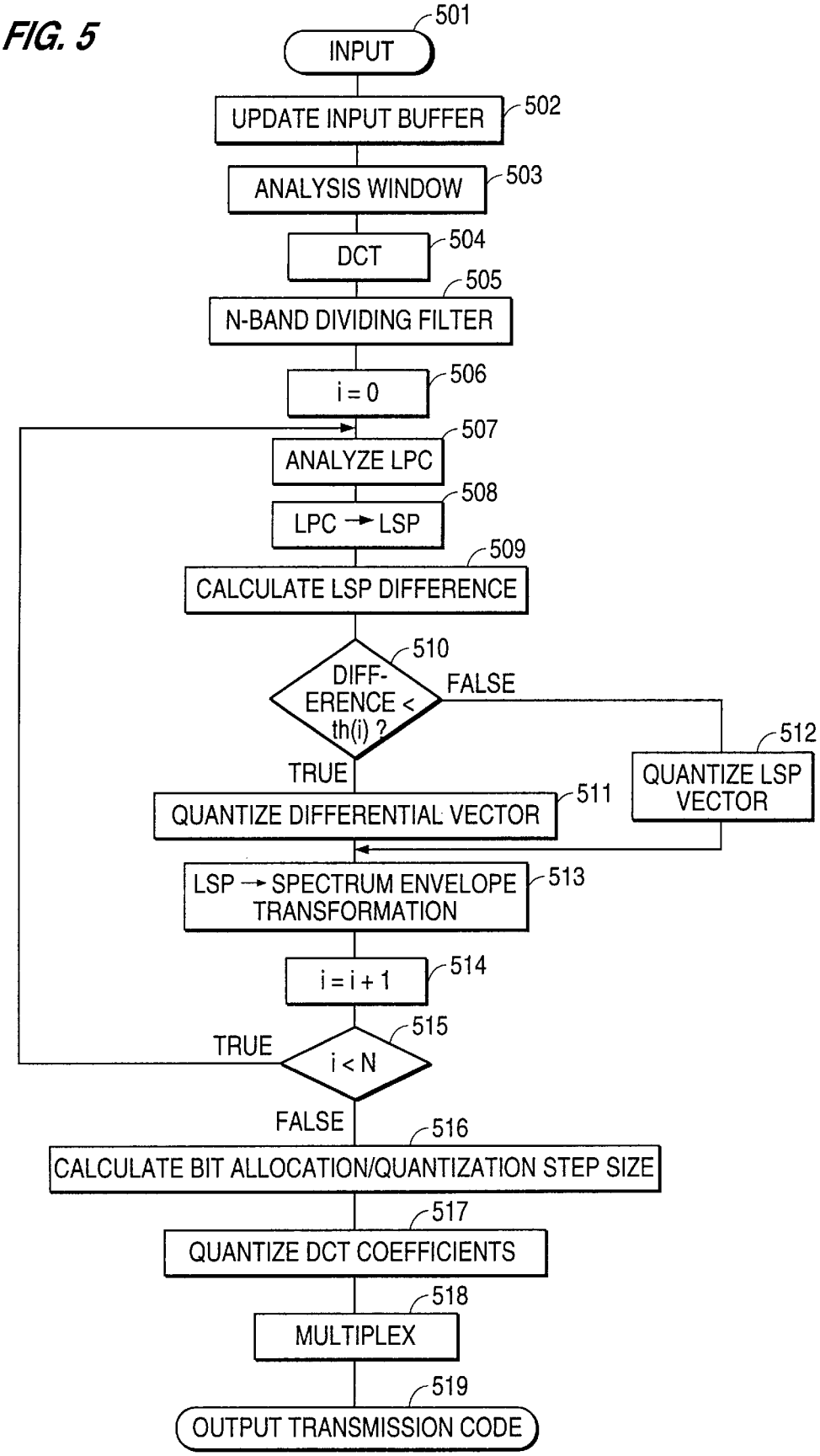
FIG. 5 is a flow chart of the coding method of a second embodiment of the present invention.
Figure 6:
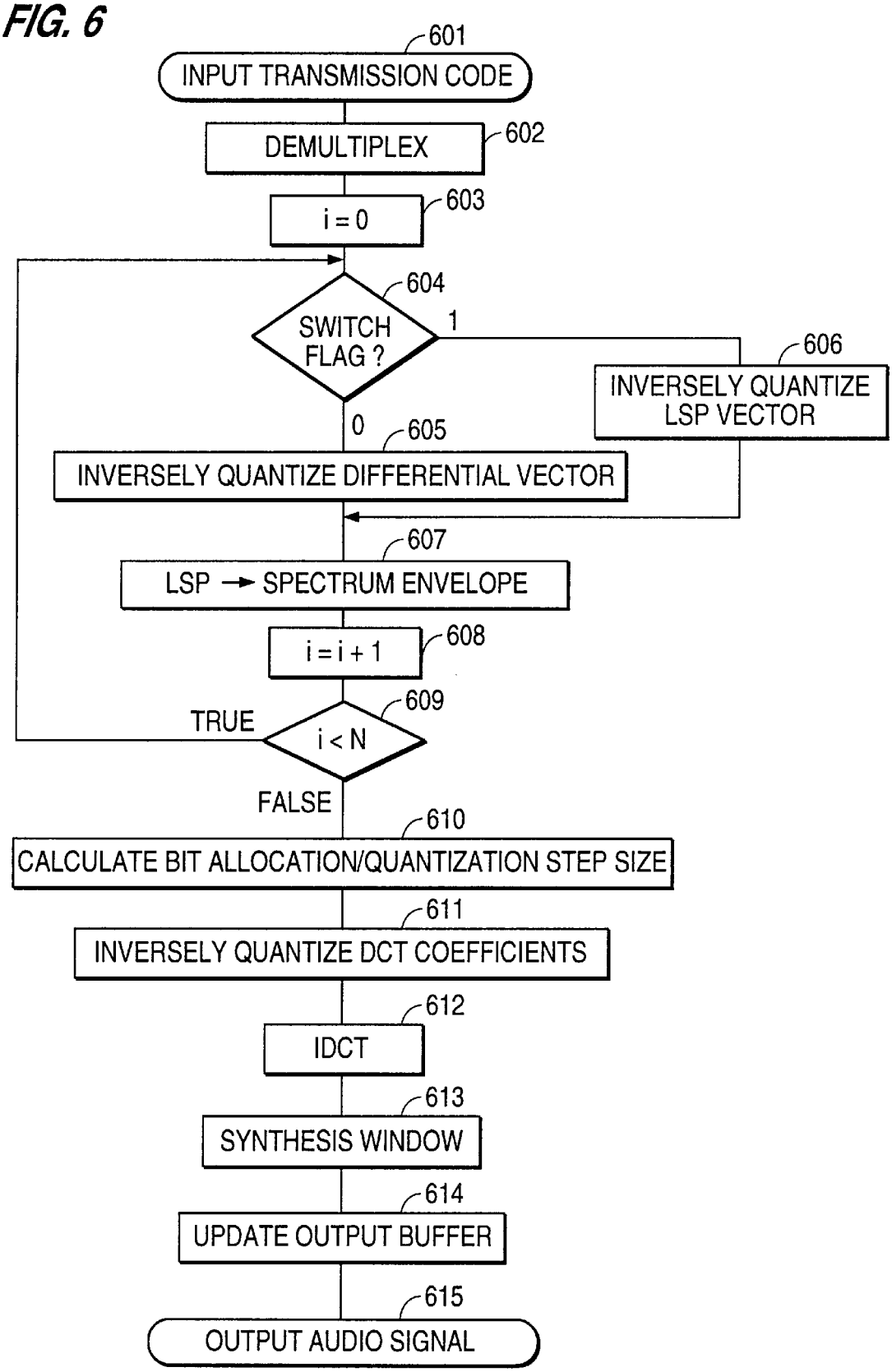
FIG. 6 is a flow chart of the decoding method of the second embodiment of the present invention.

Next, a flow chart of a second embodiment of the present invention is shown in FIGS. 5 and 6. Of these, FIG. 5 is a coding flow chart of the present embodiment, and FIG. 6 is a decoding flow chart. Incidentally, in FIGS. 5 and 6, i represents an index of a spectrum envelope coding divided band allocated sequentially from the lower frequency domain side, and N represents the number of spectrum envelope coded divided bands. In the present embodiment, too, the band is divided into two: the lower frequency domain and the higher frequency domain. Incidentally, the present embodiment is illustrated by the flow charts, from which the block diagrams can be easily constructed.

First of all, the coding operations will be described with reference to FIG. 5. In the coding operations, the sampled audio signal inputted at an input 501 is constructed into a coding block at a buffer updating step 502. The sampling frequency in the present embodiment is 16 KHz; although, of course, the invention is not limited to this. In the present embodiment, moreover, the coding block is composed of 256 samples, of which 16 samples are an overlapped component. This is multiplied by an analysis window having an L of 256 and an M of 16, as in Equation 1, by an analysis window 503 and is subjected to the discrete cosine transformation at 256 points by a DCT 504. For the spectrum envelope calculation/and coding purpose, on the other hand, the coding block is divided into signals of N bands by an N-band dividing filter 505. In the present embodiment, N is set to N=2, and the well-known QMF of 24 taps is used as the dividing filter. To begin, a band index i initialization Step 506 is carried out (noting a corresponding band index i initialization Step 603 in FIG. 6). For the signal of the band i, moreover, an LPC coefficient of m(i)-th degree is calculated at an LPC analysis 507 and is transformed into an LSP coefficient in an LPC→LSP Step 508. At an LSP difference calculation 509, moreover, a difference from the quantization LSP coefficient of the just preceding block is calculated according to Equation 5. In Equation 5, however, p represents the degree of an LSP coefficient, n represents a block being coded, n-1 represents an index indicating the just preceding block, and lsp represents a difference value.

$$\Delta lsp_p(n) = \frac{lsp_p(n) - lsp_p(n-1)}{lsp_p(n-1)}$$

After a band i difference decision Step 510, the difference value is either subjected to a vector quantization at the kd(i) bits in a differential vector quantization 511, in case its absolute value has an average value smaller than th(i), or the LSP coefficient is subjected to a vector quantization at k(i) bits in an LSP vector quantization 512. The quantized LSP coefficient thus obtained is transformed into the spectrum envelope in an LSP spectrum envelope transformation Step 513, followed by a band index i addition Step 514, and a band division end processing Step 515.

The aforementioned operations of Steps 507 to 515 are executed for the N band to approximate the spectrum envelope of the full band. On the basis of this, the bit allocation/and quantization step size of each discrete frequency band to be applied to a DCT coefficient quantization 517 are determined by a bit allocation/and quantization step size calculation 516 to quantize the DCT coefficient determined in advance. In the present embodiment, the calculating equations, which are obtained by setting the value L to 256 and the value R* to 1.47 in Equations 2 and 3, are applied to the bit allocation/and quantization step size calculation 516, and the well-known Max quantizer (of 1 to 5 bits) is used for quantizing the DCT coefficient. In a multiplexing Step 518, moreover, the DCT coefficient code, the LSP coefficient code, and the difference/or non-difference value switching flag (0/1) for coding the LSP of the band i are multiplexed and are outputted as the transmission codes 519 having a total bit rate of 360 bits/block.

At the decoding side, first of all, the DCT coefficient code, the LSP coefficient code, and the difference/non-difference value switching flag (0/1) for coding the LSP of the band i are received in Step 601 and divided in a demultiplexing Step 602. For each band i, moreover, the LSP coefficient is decoded by a inversely differential vector quantization 605 or an inversely LSP vector quantization 606 in accordance with the switching flag Step 604, and the spectrum envelope of the band i is decoded in an LSP spectrum envelope transformation Step 607. A band index i addition Step 608 and a band division processing and decision Step 609 are then carried out.

These operations are executed for the N bands to decode the spectrum envelopes of the full band, and the bit allocation/or quantization step size of the DCT coefficient of each discrete frequency band are determined by a bit allocation/and quantization step size calculation 610 so that the DCT coefficient is decoded by an inversely DCT coefficient quantization 611. This is subjected to an inverse cosine transformation at 256 points by an IDCT 612, and is multiplied in a synthesis window 613 by the window of Equation 4. The overlapped component is added in an output buffer updating Step 614 to decode the audio output signal 615.

In the present embodiment, the values m(i), th(i), kd(i) and k(i) are given the values, as enumerated in Table 1.

| i | m (i) | th (i) | kd (i) | k (i) |
|---|---|---|---|---|
| 0 | 12 | 0.2 | 10 | 16 |
| 1 | 8 | 0.2 | 5 | 7 |

According to the present embodiment, the spectrum envelope of the higher or lower frequency domain can be followed, even if it highly fluctuates, and the redundant bits can be reduced if the time fluctuation is low. In the adaptive transform coding method, all the bits other than the bit for the spectrum envelope coding are used for the DCT coefficient quantization so that the sound quality can be improved in the block having its redundant bits reduced. Thanks to this effect, according to the method of the present invention, the sound quality can be improved in a section having less fluctuation of the input spectrum than the method of the prior art for the same transmission bit rate.

By applying the method of the present embodiment to the speech transmission system of 24 Kbits/s, moreover, better sound quality can be achieved than that of the prior art system for the same bit rate.

Figure 7:
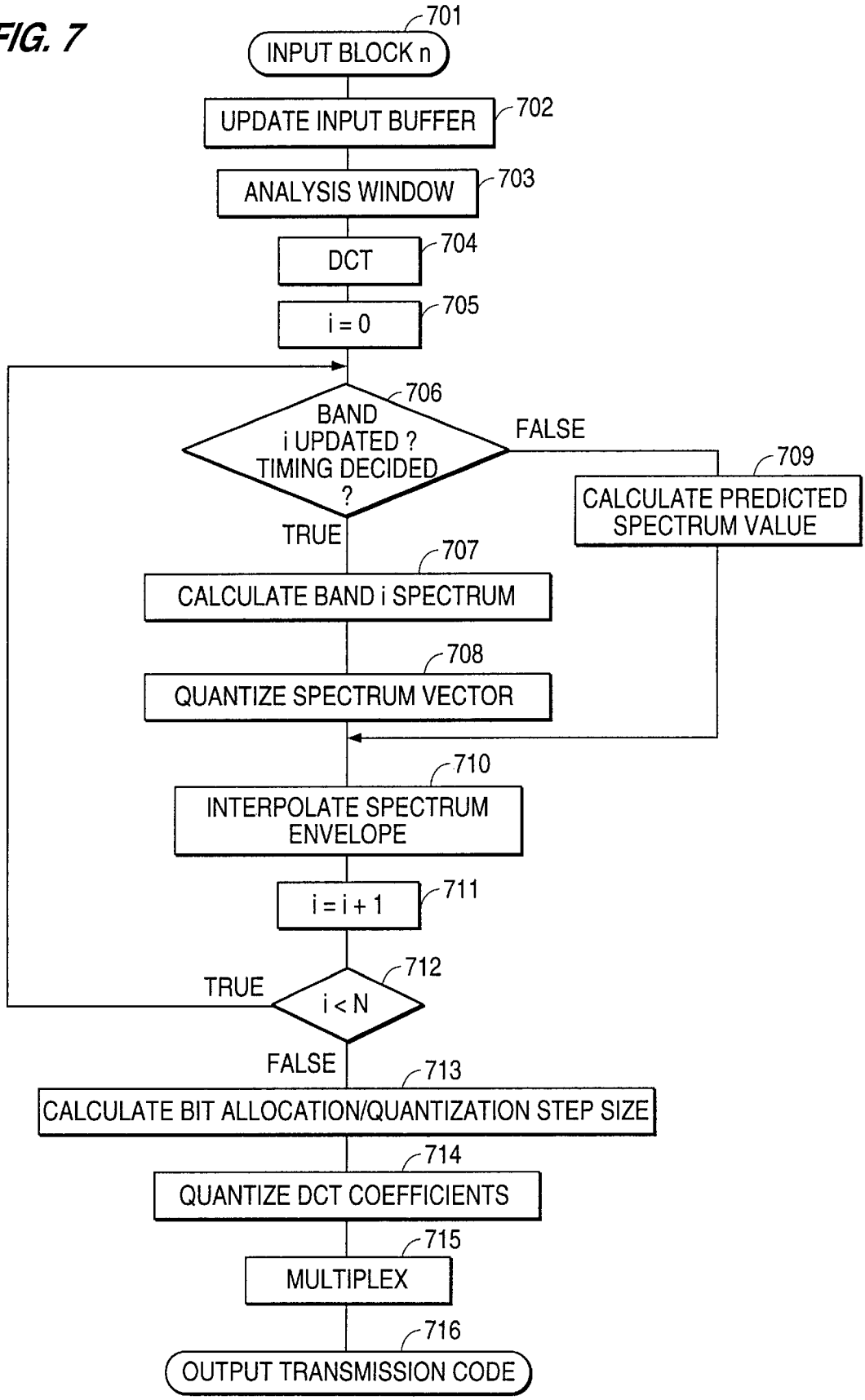
FIG. 7 is a flow chart of the coding method of a third embodiment of the present invention.

The flow chart of a third embodiment of the present invention is shown in FIGS. 7 and 8. Of these, FIG. 7 is a coding flow chart of the present embodiment, and FIG. 8 is a decoding flow chart. Incidentally, in FIGS. 7 and 8, n represents an index of a coding block allocated sequentially from the coding block 0 at the coding start, and i represents an index of the spectrum envelope coding divided band allocated sequentially from the lower frequency domain. The present embodiment also has its band divided into two: a lower frequency domain and a higher frequency domain. Incidentally, the present embodiment is illustrated by the flow charts, from which the block diagrams can be easily made.

First of all, the coding operations will be described with reference to FIG. 7. In the coding operations, the sampled audio signal inputted at an input 701 is constructed into a coding block at an input buffer updating Step 702. The sampling frequency in the present embodiment is 32 KHz. In the present embodiment, moreover, the coding block is composed of 256 samples, of which 16 samples are an overlapped component. This is multiplied by an analysis window having an L of 256 and an M of 16, as in Equation 1, by an analysis window 703 and is subjected to the discrete cosine transformation at 256 points by a DCT 704. For the spectrum envelope calculation/and coding purpose, moreover, the DCT coefficient is divided into N bands. In the present embodiment, this division is made, as enumerated in the column of the band i in Table 2. Table 2 tabulates the indexing range-of the frequency band of the DCT coefficients belonging to the band i.

| i | Construction (i) of Band i | Updating Timing m (i) | m (i) | k (i) |
|---|---|---|---|---|
| 0 | 0 ~ 63 | n: multiple of 3 | 2 | 24 (split-VQ) |
| 1 | 64 ~ 127 | n: multiple of 2 | 2 | 20 (split-VQ) |
| 2 | 128 ~ 255 | all n | 4 | 20 (split-VQ) |

As to the signal of the band i, moreover, after a band index i initialization Step 705, it is decided at a band i updating timing decision 706 whether or not the block n is at the updating timing of the band i, and the spectrum calculation/and coding operation and the spectrum decoding operation are switched. This switching can be adaptively executed according to the time fluctuation of the spectrum envelope but is fixed in the present embodiment so that it is effected under the updating timing conditions, as enumerated in Table 2. At the spectrum calculation/and coding operation, moreover, the averages of an m(i) number of DCT coefficients are sequentially calculated from the lower frequency domain by a band i spectrum calculation 707, and the vector quantization of k(i) bits is executed at a spectrum vector quantization 708. In the case of no spectrum updating, on the other hand, a predicted value is calculated from the preceding spectrum at a predicted spectrum value calculation 709 to provide the spectrum envelope of the block n. This predicted value calculation is executed by the method, as expressed by Equation 6. Incidentally, in Equation 6, $a_{jr}$ represents a prediction coefficient; and Q represents a prediction degree. In the present embodiment, the prediction degree Q is set to 2, and the prediction coefficient $a_{jr}$ is exemplified by a value which is learned by the LBG (Linde, Buzo, Gray, 1980) cluster-splitting ralgorithm or the like on the basis of a number of data.

$$\sigma_j(n) = \sum_{r=1}^{Q} a_{jr}\sigma_j(n-r)$$

At a spectrum interpolation Step 710, the spectrum quantized value or predicted value is linearly interpolated in a logarithmic domain into the spectrum envelope of the band i. Then, a band index addition Step 711 and a band index end decision Step 712 are carried out.

The aforementioned operations of Steps 706 to 712 are executed for the N bands to approximate the spectrum envelopes of the full band. On the basis of this, the bit allocation/and quantization step size of each discrete frequency band, as is applied to a DCT coefficient quantization 714, are determined by a bit allocation/and quantization step size calculation 713 , and the DCT coefficient determined in advance at Step 704 is quantized. In the present embodiment, Equation 2 having the R* of 1.25 and Equation 3 are applied to the bit allocation/and quantization step size calculation 713, and the DCT coefficient quantization 714 is composed of the well-known Max quantizer (of 1 to 5 bits). At a multiplexing Step 715, moreover, the DCT coefficient code and the spectrum code are multiplexed to output the transmission code 716.

At the decoding side, first of all, the DCT coefficient code and the spectrum code of Step 801 are divided at a demultiplexing Step 802. For each band i, moreover, an inverse spectrum vector quantization 805 or a spectrum predicted value calculation 806 is executed according to a band i switching timing decision 804, and a linear interpolation is executed in the logarithmic domain at a spectrum interpolation 807 to decode the spectrum envelope of the band i. A band index addition step 808 and a band end decision Step 809 are then carried out.

The aforementioned operations of Steps 804 to 809 are executed for the N bands to construct the spectrum envelope of the full band. The bit allocation/and quantization step sizes of the DCT coefficient of each discrete frequency band are determined at a bit allocation/and quantization step size calculation 810 to decode the DCT coefficient at an inverse DCT coefficient quantization 811. This is subjected to an inverse cosine transformation at 256 points in an IDCT 812 and is multiplied by the window of Equation 4 at a synthetic window 813, and an overlapped component is added in an output buffer updating Step 814 thereby to decode the audio output signal 815.

According to the present embodiment, a domain having a small fluctuation of the spectrum envelope has its spectrum envelope determined only by the prediction method but contains a block which is not to be transmitted. Therefore, the average transmission bit rate can be reduced while maintaining good sound quality.

By applying the method of the present embodiment to an audio signal recording system of 48 Kbits/s, moreover, it is possible to achieve a sound quality which is equivalent to that of the prior art system having a transmission bit rate of 64 Kbits/s.

Incidentally, the first, second and third embodiments discussed above all exemplify methods in which the full band of the spectrum envelope is divided into two bands, i.e., a lower frequency domain and a higher frequency domain so that different coding/and decoding methods are applied to the lower and higher frequency domains. However, the number of divisions is not limited to two, but may be three or more so that different coding/and decoding methods may be applied to the divided domains or so that a common coding/and decoding method may be applied to some of the divided bands, depending on what is most appropriate for each of the bands.

According to the present invention, the spectrum envelope to be used in the adaptive transform coding method can be adjusted to use a coding/and transmission method which is suitable for the time fluctuation in each frequency band, to provide an audio signal coding/and decoding method making effective use of redundancies which are different for the different bands. According the present invention, moreover, the spectrum envelope coding/and decoding method of each frequency band can be adaptively changed according to the time fluctuation thereby to realize an adaptive transform coding method which makes effective use of the redundant components of the spectrum envelope independently of the properties of the audio signal.

We claim:

1. A method of audio signal coding which calculates a spectrum envelope from an input audio signal and decides a coding parameter from said spectrum envelope, comprising the steps of:

dividing said input audio signal into a first part and a second part;

calculating the spectrum envelope from said input audio signal;

coding said first part by a first coding scheme and creating a first coded spectrum envelope from the coded first part and said calculated spectrum envelope and coding said second part by a second coding scheme and creating a second coded spectrum envelope, decoding said first and second coded spectrum envelopes and deciding a coding parameter of the input audio signal based on said decoded first and second spectrum envelopes;

coding said input audio signal using said coding parameter to generate a coded input audio signal; and transmitting said first coded spectrum envelope and said coded input audio signal.

2. A method according to claim 1, wherein said first part is a higher band and said second part is a lower band of the spectrum envelope.

3. A method according to claim 2, wherein said first coding scheme is a vector quantization and wherein an adaptive method is applied to said second part.

4. A method according to claim 1, wherein said coding parameter is bit allocation.

5. A method according to claim 1, wherein said coding parameter is quantization step size.

6. A method according to claim 1, wherein said first coded spectrum envelope and said coded input audio signal are multiplexed for transmission.

7. A method of audio signal coding which calculates a spectrum envelope from an input audio signal and decides a coding parameter from said spectrum envelope, comprising the steps of:

dividing said input audio signal into a first part and a second part;

calculating the spectrum envelope from said input audio signal;

coding said first part by a first coding scheme and creating a first coded spectrum envelope from said coded first part and said calculated spectrum envelope, and coding said second part by a second coding scheme and creating a second coded spectrum envelope, decoding said first and second coded spectrum envelopes and deciding a coding parameter of input audio signal based on said decoded first and second spectrum envelope;

coding said input audio signal using said coding parameter; and transmitting said first and second coded spectrum envelopes and said coded input audio signal.

8. A method according to claim 7, wherein said first part is a higher band and said second part is a lower band of the spectrum envelope.

9. A method of audio signal coding which calculates a spectrum envelope from an input audio signal and decides a coding parameter from said spectrum envelope, comprising the steps of:

dividing said input audio signal into a first part and a second part;

calculating the spectrum envelope from said input audio signal;

coding said first part by a first coding scheme and creating a first coded spectrum envelope from said coded first part and said calculated spectrum envelope, and coding said second part by a second coding scheme and creating a second coded spectrum envelope, decoding said first and second coded spectrum envelopes and deciding a coding parameter of the input audio signal based on said decoded first and second spectrum envelopes;

coding said input audio signal using said coding parameter;

transmitting said coded input audio signal; and transmitting said first and second coded spectrum envelopes at an update timing.

10. A method according to claim 9, wherein said update timing is predetermined every fixed period.

11. A method according to claim 9, wherein said update timing is decided when fluctuation of said first or second spectrum envelope is above a predetermined threshold.

12. A method according to claim 9, wherein said first coding scheme is vector quantization and said second coding scheme is an adaptive method.

13. An audio signal codes which codes input audio signals and decodes received coded audio signals, comprising:

a filter which divides said input audio signals into a first part and a second part;

a first calculator which calculates a spectrum envelope from said input audio signal;

a first coder which codes said first part by a first coding scheme and creates a first coded spectrum envelope from the coded first part and the calculated spectrum envelope, and a second coder which codes said second part by a second coding scheme and creates a second coded spectrum envelope;

a decoder which decodes said first and second coded spectrum envelopes;

a second calculator which calculates a coding parameter of the input audio signal based on said decoded first and second spectrum envelopes;

a second coder which codes said input audio signal using said coding parameter to generate a coded input audio signal; and a transmitter which transmits said first coded spectrum envelope and said coded input audio signal.

14. An audio signal codes according to claim 13, wherein said transmitter multiplexes said first coded spectrum envelope and said coded input audio signal.

* * * * *